United States Patent [19]

Fuller et al.

[11] Patent Number: 4,715,136

[45] Date of Patent: Dec. 29, 1987

[54] METHOD AND APPARATUS FOR CREATING A KINETIC WATER DISPLAY

[75] Inventors: Mark W. Fuller, Los Angeles; Alan S. Robinson, El Monte, both of Calif.

[73] Assignee: Wet Enterprises, Inc., Burbank, Calif.

[21] Appl. No.: 905,698

[22] Filed: Sep. 9, 1986

[51] Int. Cl.[4] ..... G09F 19/00

[52] U.S. Cl. ..... 40/406; 40/427; 40/326; 239/17

[58] Field of Search ..... 239/17, 18, 19, 20, 239/21, 22, 23; 40/406, 407, 326, 584, 439, 427

[56] References Cited

U.S. PATENT DOCUMENTS

| | | | |
|---|---|---|---|
| 220,419 | 10/1879 | Rankin | 40/406 |
| 446,897 | 2/1891 | Smith | 239/17 |
| 1,428,639 | 9/1922 | Junghans et al. | 40/326 |
| 1,762,126 | 6/1930 | Smith | 40/406 |
| 3,711,698 | 1/1973 | Hess | 40/406 X |
| 3,744,166 | 7/1973 | Rielle | 40/406 |
| 3,995,151 | 11/1976 | Nordeen et al. | 40/406 X |
| 4,072,855 | 2/1978 | Marchese | 40/406 X |
| 4,111,363 | 9/1978 | Kawamura | 40/406 |
| 4,170,035 | 10/1979 | Walker | 40/406 X |
| 4,190,312 | 2/1980 | Bailey | 40/406 X |
| 4,205,785 | 1/1980 | Stanley | 239/17 |
| 4,265,402 | 5/1981 | Tsai | 40/406 |
| 4,591,094 | 5/1986 | Morris | 239/17 |

FOREIGN PATENT DOCUMENTS

| | | | |
|---|---|---|---|
| 5251.41 | 4/1942 | Netherlands | 40/584 |

*Primary Examiner*—Gene Mancene
*Assistant Examiner*—Wenceslao J. Contreras
*Attorney, Agent, or Firm*—Blakely, Sokoloff, Taylor & Zafman

[57] ABSTRACT

An apparatus and method for creating a kinetic water display is provided having a plurality of water jets for outputting streams of water and also having a transparent plate of clear glass or acrylic material. The transparent plate is disposed proximate to and in opposing relationship to the streams of water such that the streams impinge upon the inner surface of the transparent plate thereby forming at least one kinetic shape comprised of ambient air and water upon the inner surface of the transparent plate.

28 Claims, 4 Drawing Figures

Fig. 1
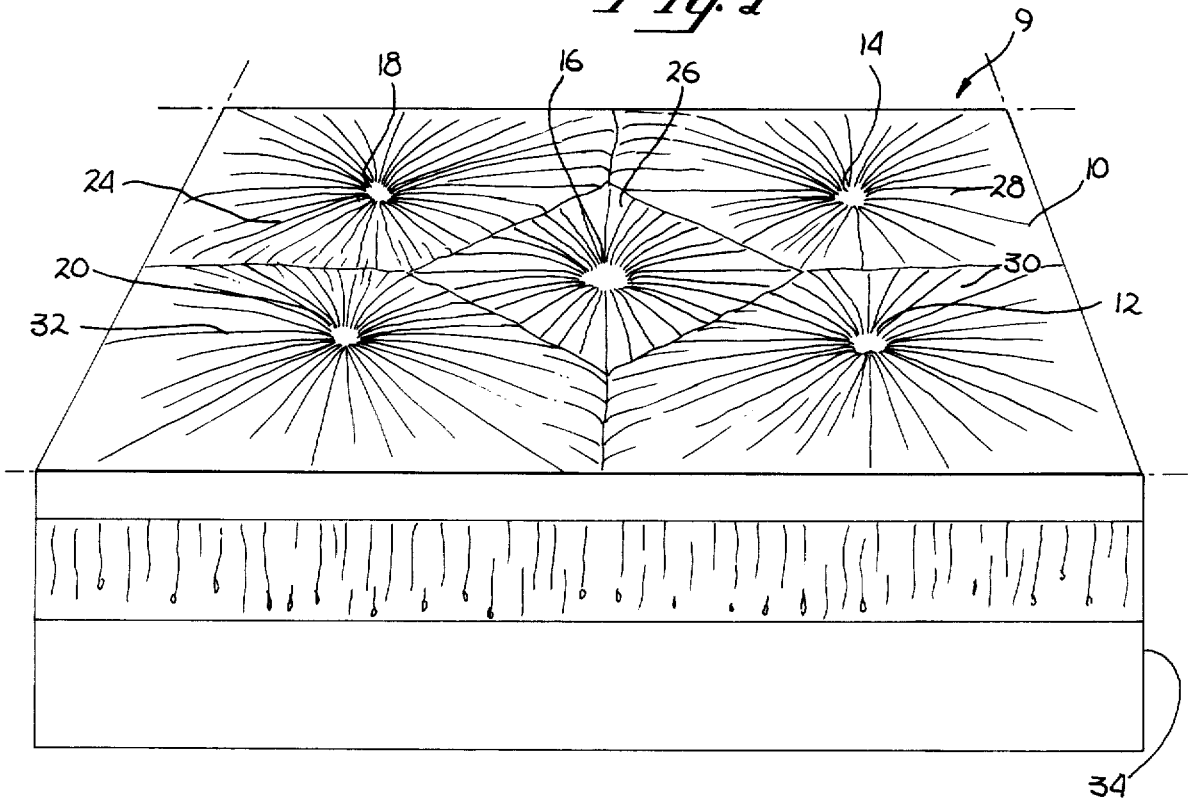
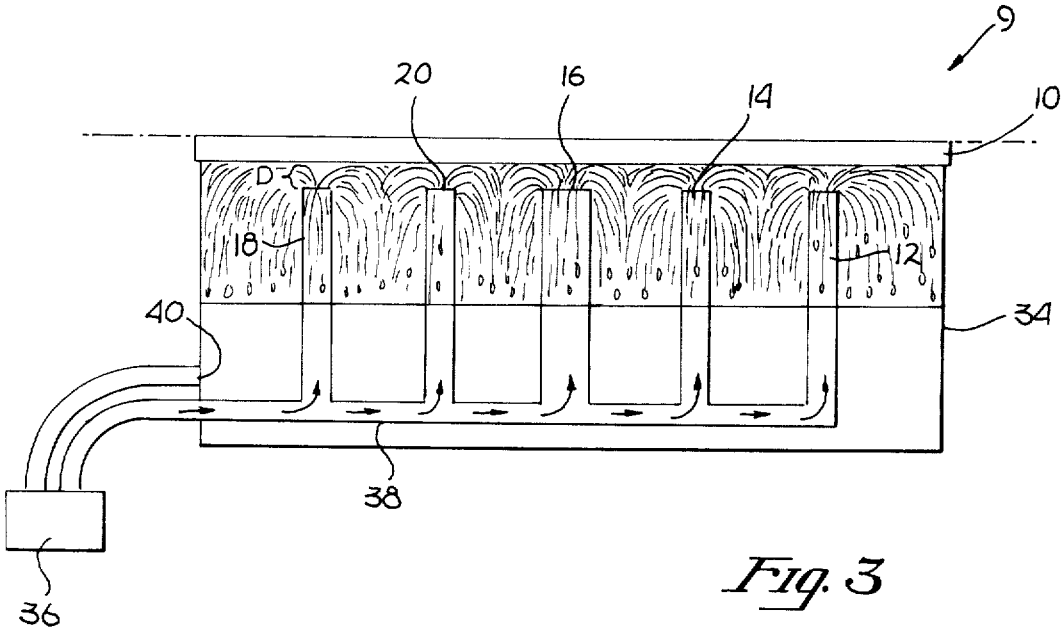
Fig. 3

METHOD AND APPARATUS FOR CREATING A KINETIC WATER DISPLAY

BACKGROUND OF THE INVENTION

Field of the Invention

The present invention relates to a method and apparatus for creating an asthetically pleasing display of moving water and, more particularly, relates to a method and apparatus for creating a kinetic water display.

SUMMARY OF THE INVENTION

It is an object of the present invention to create an aesthetically pleasing kinetic water display.

It is a further object of the present invention to provide a method and apparatus for creating a kinetic water display for placement within sidewalks, lobbys, etc. wherein the apparatus has sufficient structural integrity to permit walking there across by viewers.

Still other objects will become apparent after a reading of the foregoing specification.

The above objects are achieved in an apparatus and method for creating a kinetic water display. The apparatus comprises a means for generating at least one stream of water in a first direction and a transparent plate means being disposed at a substantial angle and in opposing relationship to the first direction of the stream of water. The plate means is disposed across the means for generating the at least one stream of water such that the stream impinges upon the inner surface of the bridge means thereby forming at least one kinetic shape comprised of ambient air and the water upon the inner surface of the plate means, whereby an aesthetically pleasing kinetic water display viewable from above said outer surface is achieved.

The method of the present invention comprises the steps of; disposing a transparent plate means, having inner and outer surfaces, at a substantial angle to and across a means for generating at least one stream of water;

actuating the means for generating at least one stream of water such that the stream flows in a first direction, the first direction being in opposing relationship to the transparent plate means; wherein the at least one stream impinges upon the inner surface of the transparent plate means thereby forming at least one kinetic shape comprised of ambient air and the water upon the inner surface of the plate means; whereby an aesthetically pleasing kinetic water display viewable from above the outer surface of the transparent plate means.

BRIEF DESCRIPTION OF THE DRAWING

In FIG. 1 there is shown a perspective view of the present invention;

In FIG. 3 there is shown a partial cross-sectional view of the present invention;

DETAILED DESCRIPTION OF THE INVENTION

Figure 2:
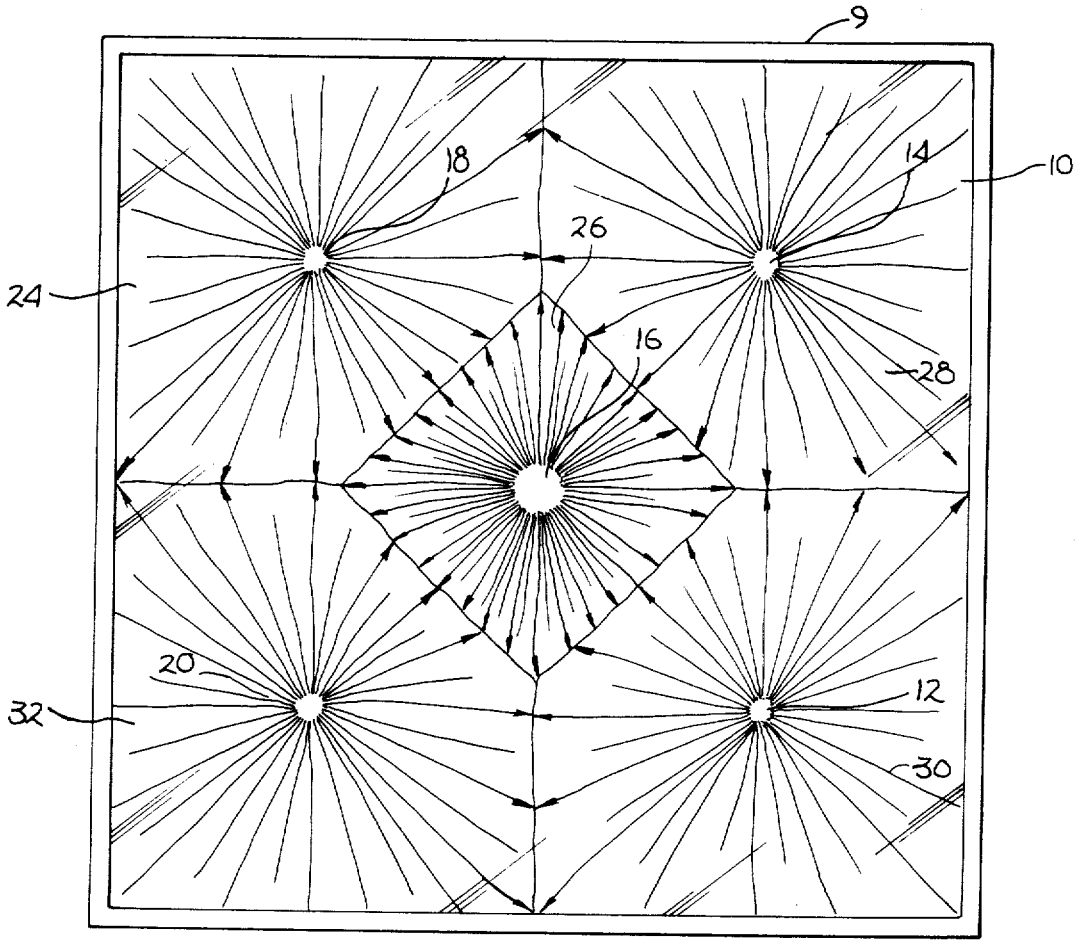
In FIG. 2 there is shown a top plan view of the present invention.

The foregoing description will include reference to FIGS. 1, 2 and 3. The kinetic water display apparatus is generally denoted by reference numeral 9.

A generally large transparent plate of clear glass 10 having a sufficient structural integrity to hold persons walking upon it is disposed generally above a plurality of water jets, 12, 14, 16, 18 and 20. As shown in FIG. 3, the jets 12, 14, 18 and 20 are generally equa-distantly spaced apart from the central jet 16, and the outlets thereof are disposed a predetermined distance D apart from the glass plate 10. In the particular embodiment herein disclosed as an example of the present invention, the glass plate 10 has thickness in the range of between ¾ to 1½ inches and a length and width of approximately 5 feet. It will be appreciated, however that the dimensions of the glass plate 10 are not particularly relevant to the practice of the present invention, so long as the requirements of structural integrity and substantial transparency are satisfied.

Figure 4:
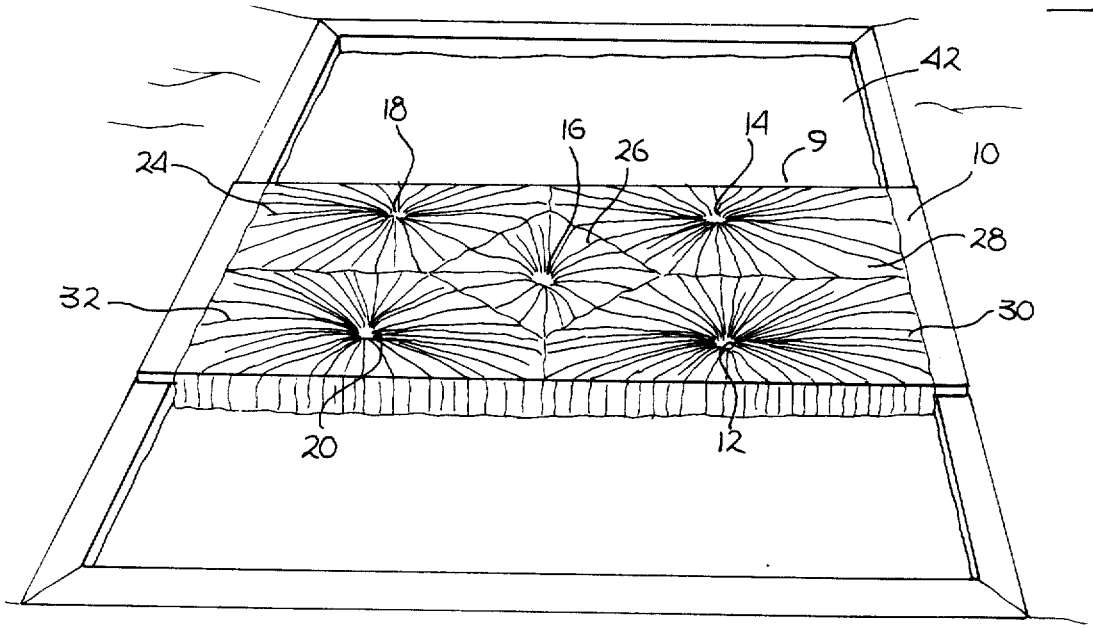
In FIG. 4 there is shown a perspective view of the present invention installed in a pool.

The glass plate 10 is supported at the sides or corners thereof such that the plate 10 is generally co-planar with the surrounding area in which the apparatus 9 is installed, as indicated by the phantom lines in FIGS. 1, 3, and 4.

It will be appreciated to those skilled in the art that the glass plate 10 may also be comprised of nearly any transparent material having similar transparency characteristics as that of clear glass and which also has a structural integrity sufficient enough to continuously support persons walking upon the outer surface thereof.

The plurality of jets 12, 14, 16, 18 and 20 output a generally continuous stream of turbulent water and, because of their proximity to the glass plate 10, the water outputted from the jets impinges upon the inner surface of the glass plate 10 such that a plurality of outwardly spreading columns of water is continuously achieved at the areas of the glass plate surrounding each of the jets. The spreading columns of water and their interaction with one another form various kinetic (i.e. constantly and slightly varying) graphic shapes 24, 26, 28, 30 and 32. This effect is best observed in FIG. 2 wherein a top plan view of the apparatus 9 and the kinetic graphic shapes 24, 26, 28, 30 and 32 are shown.

The jets 12, 14, 16, 18 and 20 comprise generally cylindrical tubes and in the preferred embodiment are comprised of substantially clear acrylic tubes having an inner diameter ranging from 1 inch to 3 inches. However, it will be appreciated that, the jets may be formed from other material and may also have inner diameters less than 1 inch or greater than 3 inches. As may be observed from FIG. 2, the centrally located jet 16 has a larger inner diameter than the jets on either side thereof such that the central spreading column of the kinetic graphic shape 26 has greater flow and turbulence than the adjacent shapes 24, 32, 28 and 30, and such that the interaction of shape 26 with the adjacent shapes forms a kinetic generally square pattern in the central area of the glass plate 10, while the other columns form a kinetic generally five sided graphic shape.

It will thus be appreciated that various other desired kinetic graphic shapes may similarly be formed on the inner surface of the glass plate 10 through selective arrangement and orientation of the water jets, variation of the number of water jets used and the inner diameters thereof such that a nearly infinite variety of water patterns forming various kinetic graphic shapes may be achieved.

With reference to FIG. 3, which illustrates a partial cross-sectional view of the apparatus 9, a pump means 36 supplies each of the jets 12, 14, 16, 18 and 20 with a continuous flow of water. Water outputted by the jets and returning from plate 10 is retained by tank means 34 and is syphoned through port 40 by the pump means 36 for recirculation. It will be appreciated that in order to maintain a substantially uniform velocity of outflowing water at each of the jets, and to adjust the same, various valving arrangements may be employed at the base of the jets that communicate with common conduit 38 such that the flow of water received by each jet is as desired. It will also be appreciated that various pumping and piping arrangements, other than that illustrated, may be employed with the present invention. Further, as previously indicated, it will be appreciated that jets having various inner diameters may be used for creating corresponding water patterns, or even linear jets, linear arrays of jets or jets of other shapes. Also, while the preferred embodiment, whether used as part of a walkway or only as a decoration, is illustrated as being horizontal, similar inclined or even vertical arrangements may also be used, the pump of course still being at the lower region thereof. Whether horizontal or not, display should be less than full of water to get the desired water flow patterns unless colored particles or the like were put in the water to provide an aesthetically pleasing visual perception of the nature, patterns, etc. in the flow.

Moreover, as may best be observed from FIG. 2, there is an additional aesthetically pleasing effect created by the apparatus 9 in that the turbulent columns of water which surround each jet appear to have a hollow center since, due to the forces that act upon the water in its path from the outlet of the jets as it impinges against the glass plate 10, the area in the center of the jets is substantially free from outflowing water and air such that the water hugs the inner diamater of the jets at their respective outlets, thereby appearing to present spreading columns of water that have a hollow center and which also appear, due to the transparrency of the jets, to continuously emanate from no observable source of origin.

The apparatus for creating a kinetic water display may be installed in a sidewalk, hotel lobby floor, or any other area where an aesthetically pleasing water effect is desired.

An important aspect of the present invention being that the structure which is partly responsible for the aforedescribed kinetic graphic shapes (glass plate 10) also provides a means upon which people may walk and view the effect from directly above the spreading columns of water, as if they were standing upon the very columns of water. As such, it will be appreciated that since the glass plate 10 is transparent, a person walking across the same would encounter the optical illusion of walking across a virtual bridge of turbulent water columns which continuously form various kinetic graphic shapes.

A particularly dramatic installation is illustrated in FIG. 4 wherein the apparatus 9 is shown installed in a pool 42 with the glass plate 10 spanning from one side of the pool to the other side thereof. Due to the water of the pool which surrounds the apparatus 9, the optical illusion of walking across a bridge of water is heightened.

It will also be appreciated, as stated before, that the apparatus 9 may be mounted vertically in a wall, or separately as a self contained unit. Such installations of the present invention serves a highly desirable relatively maintenance free alternative to aquariums or other aqueous display devices.

It will also be appreciated that the above described invention may be embodied in other specific forms without departing from the spirit or essential characteristics thereof. The present embodiment is to be considered, therefore, in all aspects as illustrative and unrestrictive, the scope of the invention being indicated by the appended claims rather than by the foregoing description, and all changes which come within the meaning and range of equivalency are, therefore, intended to be embraced therein.

What is claimed is:

1. An apparatus for creating a kinetic water display effect, said apparatus comprising:

means for generating at least one stream of water in a first direction;

transparent plate means having inner and outer surfaces, said plate means being disposed at a substantial angle and in opposing relationship to said first direction of said at least one stream of water, said plate means being disposed across said means for generating said at least one stream of water such that said stream impinges upon the inner surface of said plate means thereby forming at least one kinetic shape comprised of ambient air and said water upon said inner surface of said plate means;

whereby an aesthetically pleasing kinetic water display viewable from a location above said outer surface of said transparent plate means is achieved.

2. The apparatus for creating a kinetic water display as claimed in claim 1 wherein said means for generating at least one stream of water comprises a plurality of water jets such that said plurality of jets generate a corresponding plurality of water streams and such that said plurality of water jets, in cooperation with said transparent plate means, creates a corresponding plurality of kinetic shapes.

3. The apparatus for creating a kinetic water display claimed in claim 2 wherein said corresponding plurality of kinetic shapes interact with one another thereby forming an equal number of kinetic graphic shapes.

4. The apparatus for creating a kinetic water display as claimed in claim 3 wherein said plurality of water jets each are comprised of a generally cylindrical tube comprised of substantially transparent material.

5. The apparatus for creating a kinetic water display as claimed in claim 1 wherein said at least one stream is substantially column shaped having an outer periphery of said water and an inner area comprised of said ambient air.

6. The apparatus for creating a kinetic water display as claimed in claim 4 wherein said cylindrical tubes are substantially equa-distantly spaced apart from a one of said tubes.

7. The apparatus for creating a kinetic water display as claimed in claim 4 wherein said substantially transparent material is acrylic.

8. The apparatus for creating a kinetic water display as claimed in claim 1 wherein said transparent plate means comprises a plate of substantially clear glass having a predetermined length and width, said glass being of sufficient structural integrity such that said glass may be used as a bridge to support persons walking there across.

9. The apparatus for creating a kinetic water display as claimed in claim 3 wherein said transparent plate means comprises a plate of substantially transparent acrylic material having a predetermined length and width, said acrylic material being of sufficient structural integrity such that said acrylic material may be used as bridge to support persons walking there across.

10. The apparatus for creating a kinetic water display as claimed in claim 2 wherein said plurality of jets are disposed substantially perpendicularly to said plate means.

11. The apparatus for creating a kinetic water display as claimed in claim 1 wherein said plate means is disposed within a substantially horizontal plane.

12. The apparatus for creating a kinetic water display as claimed in claim 1 wherein said plate means is disposed in a plane which is substantially inclined from a substantially horizontal plane.

13. The apparatus for creating a kinetic water display as claimed in claim 1 wherein said plate means is disposed in a substantially vertical plane.

14. The apparatus for creating a kinetic water display as climed in claim 2 wherein output ports of said plurality of water jets are disposed a predetermined distance above a water level formed by the run off of said plurality of water streams.

15. A method for creating a kinetic water display comprising the following steps:

disposing a transparent plate means, having inner and outer surfaces, at a substantial angle to and in opposing relationship to a means for generating at least one stream of water;

actuating said means for generating said at least one stream of water such that said at least one stream flows therefrom in a first direction, said first direction being in opposing relationship to said transparent plate means;

wherein said at least one stream impinges upon said inner surface of said transparent plate means thereby forming at least one kinetic shape comprised of ambient air and said water upon said inner surface of said transparent plate means;

whereby an aesthetically pleasing kinetic water display viewable from above said outer surface of said transparent plate means is achieved.

16. An apparatus for creating a kinetic water display effect, said apparatus comprising:

a plurality of water jets for generating a corresponding plurality of streams of water in a first direction;

a substantially transparent plate having inner and outer surfaces, said plate means being disposed at a substantial angle in opposing relationship to said first direction of said plurality of streams of water such that said streams impinge upon the inner surface of said plate thereby forming a corresponding plurality of kinetic shapes comprised of ambient air and said water upon said inner surface of said plate;

whereby an aesthetically pleasing kinetic water display viewable from a location adjacent said outer surface of said transparent plate is achieved.

17. The apparatus for creating a kinetic water display claimed in claim 16 wherein said corresponding plurality of kinetic shapes interact with one another thereby forming an equal number of kinetic graphic shapes.

18. The apparatus for creating a kinetic water display as claimed in claim 16 wherein said plurality of water jets each are comprised of a generally cylindrical tube comprised of substantially transparent material.

19. The apparatus for creating a kinetic water display as claimed in claim 16 wherein said plurality of streams are each substantially column shaped having an outer periphery of said water and an inner area comprised of said ambient air.

20. The apparatus for creating a kinetic water display as claimed in claim 18 wherein said cylindrical tubes are substantially equa-distantly spaced apart from one of said tubes.

21. The apparatus for creating a kinetic water display as claimed in claim 18 wherein said substantially transparent material is acrylic.

22. The apparatus for creating a kinetic water display as claimed in claim 16 wherein said plurality of jets are disposed substantially perpendicularly to said plate means.

23. The apparatus for creating a kinetic water display as claimed in claim 16 wherein said plate is disposed within a substantially horizontal plane.

24. The apparatus for creating a kinetic water display as claimed in claim 22 wherein said plate means is disposed in a plane which is substantially inclined from a substantially horizontal plane.

25. The apparatus for creating a kinetic water display as claimed in claim 16 wherein said plate means is disposed in a substantially vertical plane.

26. The apparatus for creating a water bridge effect as claimed in claim 16 wherein said substantial angle is in the range of 0° to 180°.

27. The apparatus for creating a kinetic water display as claimed in claim 16 wherein output ports of said plurality of water jets are disposed a predetermined distance above a water level formed by the run-off of said plurality of water streams.

28. A method for creating a kinetic water display comprising the following steps:

disposing a substantially transparent plate having inner and outer surfaces of water jets at a substantial angle to and in opposing relationship to a plurality for generating as corresponding plurality of streams of water;

actuating said water jets thereby generating said plurality of streams of water such that said stream flows from said jets in a first direction, said first direction being in opposing relationship to said transparent plate;

wherein said at least one stream impinges upon said inner surface of said substantially transparent plate thereby forming a corresponding plurality of kinetic graphic shapes comprised of ambient air and said water upon said inner surface of said transparent plate means;

whereby an aesthetically pleasing kinetic water display viewable from a location adjacent said outer surface of said transparent plate means is achieved.

* * * * *

UNITED STATES PATENT AND TRADEMARK OFFICE

CERTIFICATE OF CORRECTION

PATENT NO. :4,715,136

DATED :12/29/87

INVENTOR(S) :Fuller et al.

It is certified that error appears in the above-identified patent and that said Letters Patent is hereby corrected as shown below:

| COLUMN | LINE | |
|---|---|---|
| 6 | 42 | Delete "of water jets" |
| 6 | 45 | Insert --of water jets-- between the words "for" and "generating" |
| 6 | 45 | Delete "as" and Insert --a-- |

Signed and Sealed this

Twenty-eighth Day of June, 1988

*Attest:*

DONALD J. QUIGG

*Attesting Officer*

*Commissioner of Patents and Trademarks*